US012677901B2

(12) United States Patent
Nimura

(10) Patent No.: US 12,677,901 B2
(45) Date of Patent: Jul. 14, 2026

(54) HELMET

(71) Applicant: SHOEI Co., Ltd., Tokyo (JP)

(72) Inventor: Taku Nimura, Tokyo (JP)

(73) Assignee: SHOEI Co., Ltd., Tokyo (JP)

( * ) Notice: Subject to any disclaimer, the term of this patent is extended or adjusted under 35 U.S.C. 154(b) by 10 days.

(21) Appl. No.: 18/710,033

(22) PCT Filed: Oct. 13, 2022

(86) PCT No.: PCT/JP2022/038226
§ 371 (c)(1),
(2) Date: May 14, 2024

(87) PCT Pub. No.: WO2023/090003
PCT Pub. Date: May 25, 2023

(65) Prior Publication Data

US 2025/0000197 A1 Jan. 2, 2025

(30) Foreign Application Priority Data

Nov. 17, 2021 (JP) ..... 2021-187263

(51) Int. Cl.
*A42B 3/28* (2006.01)

(52) U.S. Cl.
CPC ..... *A42B 3/28* (2013.01)

(58) Field of Classification Search
CPC ..... A42B 3/28; A42B 3/283
See application file for complete search history.

(56) References Cited

U.S. PATENT DOCUMENTS 4,964,178 A 10/1990 Giancarlo et al.
6,263,513 B1 7/2001 Murakami
6,425,143 B1 * 7/2002 Benedict ..... A42B 3/281 2/424

(Continued)

FOREIGN PATENT DOCUMENTS

JP H02-26908 A 1/1990
JP H073516 A 1/1995

(Continued)

OTHER PUBLICATIONS

Translated text for Tw M636779 (Year: 2022).*

(Continued)

*Primary Examiner* — Katherine M Moran
(74) *Attorney, Agent, or Firm* — Wolf, Greenfield & Sacks, P.C.

(57) ABSTRACT

A helmet provided with a hat body and an airflow controlling part that is attached to the outer surface of the hat body. The airflow controlling part is provided with two wings arranged on both sides, in the left-right direction, of a portion on the rear side of the outer surface of the hat body. Each of the two wings is connected to a rear lateral portion of the outer surface of the hat body so as to continue from parts of the rear lateral portion and defines a gap. The gap has a curved surface following a part that is of the rear lateral portion and faces the wing. The gap penetrates from the front to the rear between the rear lateral portion and the wing portion and is configured to exhaust the air entering the gap from the front toward the rear lower side.

7 Claims, 11 Drawing Sheets

(56) References Cited

U.S. PATENT DOCUMENTS

| | | | | |
|---|---|---|---|---|
| 8,726,425 | B2 * | 5/2014 | Murakami | A42B 3/0493 2/455 |
| 11,638,455 | B2 * | 5/2023 | Ishikawa | A42B 3/283 2/410 |
| 2010/0229289 | A1 | 9/2010 | Murakami | |
| 2015/0320135 | A1 * | 11/2015 | Lowe | A42B 3/22 2/411 |
| 2017/0055620 | A1 * | 3/2017 | Shida | A42B 3/0493 |
| 2020/0268087 | A1 | 8/2020 | Ishikawa | |
| 2023/0132462 | A1 * | 5/2023 | Roy | A42B 3/28 2/410 |

FOREIGN PATENT DOCUMENTS

| | | | | |
|---|---|---|---|---|
| JP | 2000-328343 | A | 11/2000 | |
| JP | 2020-133065 | A | 8/2020 | |
| TW | M636779 | U * | 1/2023 | A42B 3/28 |
| WO | WO 2007/144937 | A1 | 12/2007 | |

OTHER PUBLICATIONS

International Search Report dated Nov. 15, 2022, in connection with International Application No. PCT/JP2022/038226, with English translation thereof.

* cited by examiner

HELMET

CROSS REFERENCE TO RELATED APPLICATIONS

This Application is a national stage filing under 35 U.S.C. 371 of International Patent Application Serial No PCT/JP2022/038226, filed Oct. 13, 2022, which claims priority to Japanese application number 2021-187263, filed Nov. 17, 2021. The entire contents of these applications are incorporated herein by reference in their entirety.

TECHNICAL FIELD

The present disclosure relates to a helmet including an airflow controller on an outer surface of a helmet body.

BACKGROUND ART

A helmet worn by a driver produces an air current that flows along the outer surface of the helmet body and an air current that flows away from the helmet body. The difference in air currents around the helmet result in differences in the wearing comfort of the helmet. An air current from the front of the helmet flows through the helmet and then out of the helmet thereby enhancing ventilation of the helmet interior (refer to, for example, Patent Literature 1 to 3). Variations in the air currents around the helmet are reduced to decrease noise, such as wind roar, and improve quietness. Disturbance in the air currents flowing away from the helmet is reduced to increase stability in the posture of the driver when driving straight forward (refer to, for example, Patent Literature 4).

CITATION LIST

Patent Literature

Patent Literature 1: Japanese Laid-Open Patent Publication No. 2-26908

Patent Literature 2: Japanese Laid-Open Patent Publication No. 7-3516

Patent Literature 3: Japanese Laid-Open Patent Publication No. 2000-328343

Patent Literature 4: International Publication No. 2007/144937

SUMMARY OF INVENTION

Technical Problem

The wearing comfort may be improved by changing the shape of the outer surface of the helmet body and producing new currents around the helmet. In any case, the helmet body is required to have high mechanical strength, high impact resistance, and high penetration resistance. This implies restrictions to the addition of new structures that would improve the wearing comfort.

Solution to Problem

One aspect of the present disclosure is a helmet including a helmet body and an airflow controller attached to an outer surface of the helmet body. The airflow controller includes two wing portions sandwiching a rear part of the outer surface of the helmet body in a transverse direction. Each of the two wing portions is connected to a rearward portion of the outer surface of the helmet body in a manner continuous with a part of the rearward portion. Each of the two wing portions is curved in conformance with a portion of the rearward portion that faces the wing portion. Each of the two wing portions defines a gap with the rearward portion extending from a front side toward a rear side with the rearward portion. Each of the two wing portions is configured to send air entering a front side of the gap out of the gap toward a lower rear side.

DESCRIPTION OF EMBODIMENTS

One embodiment of a helmet will now be described.

First, (i) the overall structure of the helmet will be described. Then, (ii) the structure of a first airflow controller will be described, and (iii) the structure of a second airflow controller will be described. Afterwards, (iv) the relative relationship of airflow control members and the operation of the helmet will be described.

A hypothetical vertical plane extending through the middle of the helmet in the transverse direction of the helmet is referred to as the transverse center plane. The side toward the left of the transverse center plane is simply referred to as the left side, and the side toward the right of the transverse center plane is simply referred to as the right side.

A hypothetical vertical plane extending through the middle of the helmet in the front-rear direction of the helmet is referred to as the front-rear center plane. The side toward the front of the front-rear center plane is simply referred to as the front side, and the side toward the rear of the front-rear center plane is simply referred to as the rear side.

A hypothetical horizontal plane extending through the middle of the helmet in the vertical direction is referred to as the vertical center plane. The side above the vertical center plane is simply referred to as the upper side, and the side below the vertical center plane is simply referred to as the lower side.

(i) Overall Structure of Helmet

Figure 1:
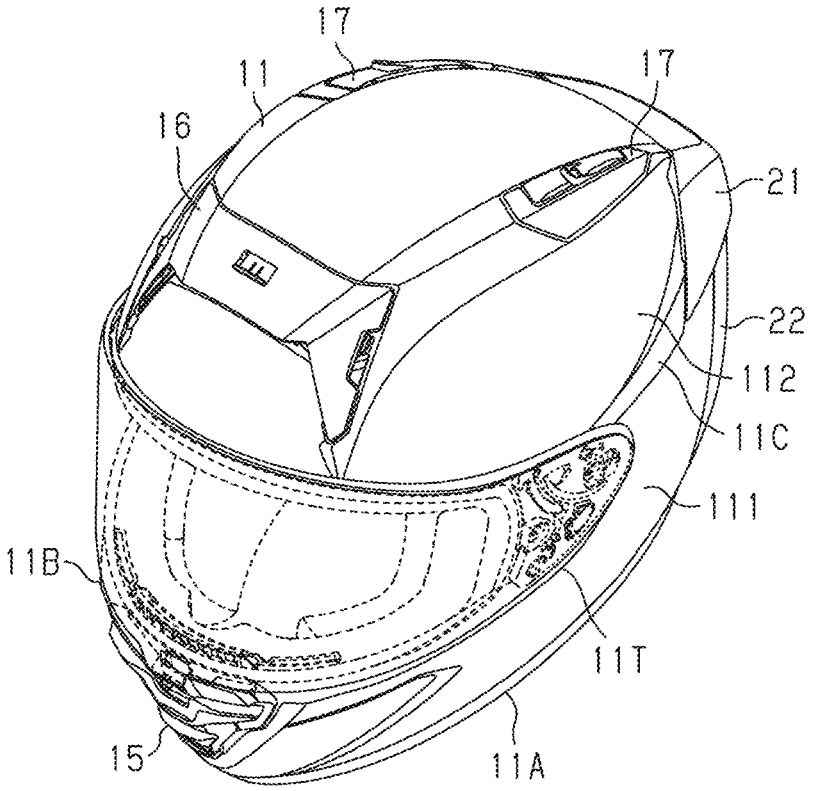
FIG. 1 is an exploded perspective view showing the front upper left structure of a helmet.

As shown in FIG. 1, the helmet includes a shell 11, which is one example a helmet body, and a rear spoiler 21, which is one example of a first airflow control member. The helmet may include two rear flaps 22. Each of the two rear flaps 22 is one example of a second airflow control member. In this manner, an airflow controller may be formed by the rear spoiler 21 and the two rear flaps 22. The shell 11 may include a front lower inlet 15, a front upper inlet 16, and top outlets 17.

The shell 11 is a plastic molded body forming the outermost shell of the helmet. The shell 11 has a semispherical shape and is substantially plane symmetric with respect to the transverse middle plane. The shell 11 is semispherical and projects slightly toward the rear. One example of the material forming the shell 11 is one selected from a group consisting of an acrylonitrile butadiene styrene copolymer, polycarbonate, and a thermosetting resin impregnated with reinforced fibers.

The shell 11 has an open lower end defining a fitting opening 11A. The fitting opening 11A allows the user to fit his or her head into the shell 11 and remove his or her head from the shell 11. The fitting opening 11A allows for the arrangement of an impact absorbent 11B inside the shell 11. The front part of the shell 11 includes a shield opening 11T. The wearer uses the shield opening 11T to view the frontal environment from inside the shell 11.

The front lower inlet 15 is located in the front lower part of the shell 11. The front lower inlet 15 draws air into the shell 11 from the front lower side of the shell 11. The air drawn into the shell 11 from the front lower inlet 15 is sent to the interior members accommodated in the shell 11 such as the impact absorbent 11B. The airflow to the interior members reduces the heat of the interior members.

The front upper inlet 16 is located at the front upper part of the shell 11. The front upper inlet 16 draws air into the shell 11 from the front upper side of the shell 11. The air drawn into the shell 11 from the front upper inlet 16 flows inside the shell 11 near the top of the head and then flows out of the two top outlets 17. One of the two top outlets 17 is located at the right part of the rear upper side of the shell 11. The other one of the two top outlets 17 is located at the left part of the rear upper side of the shell 11. The air flowing from the front upper inlet 16 to the two top outlets 17 ventilates the inside of the shell 11.

The shell 11 has an outer surface with a left part including a lower shell surface 111 and an upper shell surface 112. The outer surface of the shell 11 has a right part including the lower shell surface 111 and the upper shell surface 112. The shell 11 may include an inflow guide surface 11C at the boundary between the lower shell surface 111 and the upper shell surface 112. The left part and right part of the shell 11 may each include a single inflow guide surface 11C.

The inflow guide surface 11C in the outer surface of the shell 11 is a curved surface that is slightly and gradually bulged outward. The inflow guide surface 11C, which extends from the front side of the shell 11 toward the upper rear side of the shell 11, is arcuate and shaped in conformance with the outer surface of the shell 11. The inflow guide surface 11C extends continuously from the rear end of the shield opening 11T toward a rear part 113 of the shell 11 (refer to FIG. 2) where the rear spoiler 21 is located. The outwardly bulging amount of the inflow guide surface 11C increases gradually from the front end toward the rear end of the inflow guide surface 11C. A surface such as the inflow guide surface 11C that rises from a smooth surface decreases the flow velocity of the air in front of the rising surface and increases the flow velocity at the rear of the rising surface. In the flow of air along the outer surface of the shell 11, the inflow guide surface 11C produces an airflow in the direction in which the inflow guide surface 11C extends and increases the flow velocity of the airflow along the inflow guide surface 11C.

Figure 2:
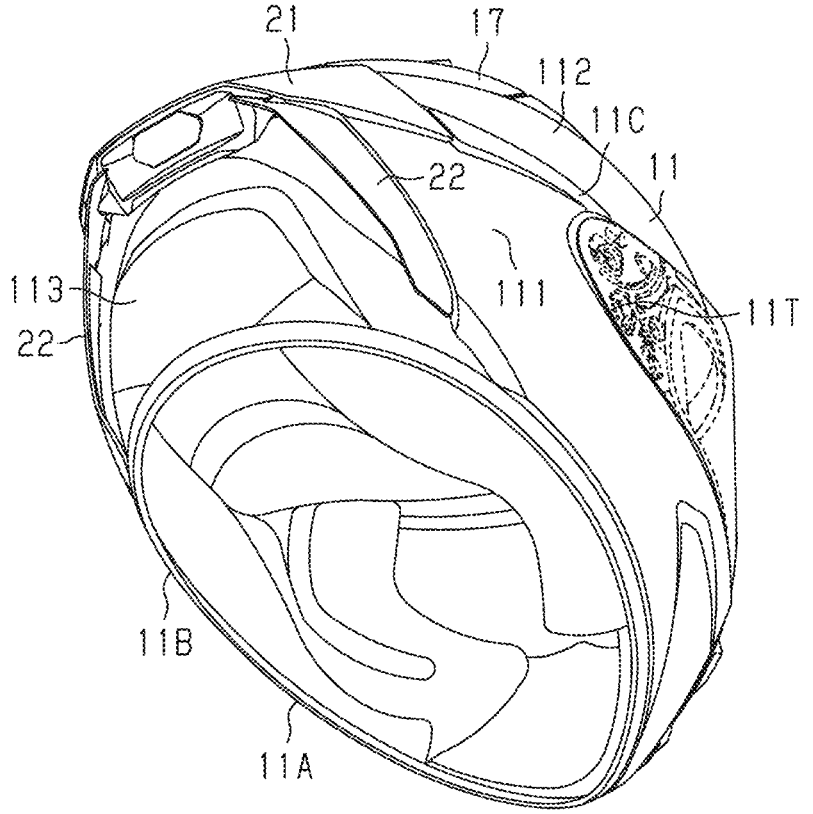
FIG. 2 is an exploded perspective view showing the rear lower right structure of the helmet.

As shown in FIG. 2, the outer surface of the shell 11 includes the rear part 113 located at the rear side of the front-rear center plane. The rear end of the inflow guide surface 11C is included in the rear part 113 of the outer surface of the shell 11.

At the upper end of the rear part 113 of the shell 11, the rear spoiler 21 extends continuously from the rear part 113 and projects toward the rear of the shell 11 from the rear part 113. The rear spoiler 21 extends continuously from the rear end of the inflow guide surface 11C and projects toward the rear of the shell 11 from the rear part 113. The rear spoiler 21 arranged on the rear part 113 of the shell 11 extends from the right part of the shell 11 to the left part of the shell 11.

At the lower portion of the rear part 113 of the shell 11, each of the two rear flaps 22 extends continuously from the rear part 113 and projects toward the rear of the shell 11 from the rear part 113. The two rear flaps 22 are respectively arranged on the right part of the shell 11 and the left part of the shell 11.

Figure 3:
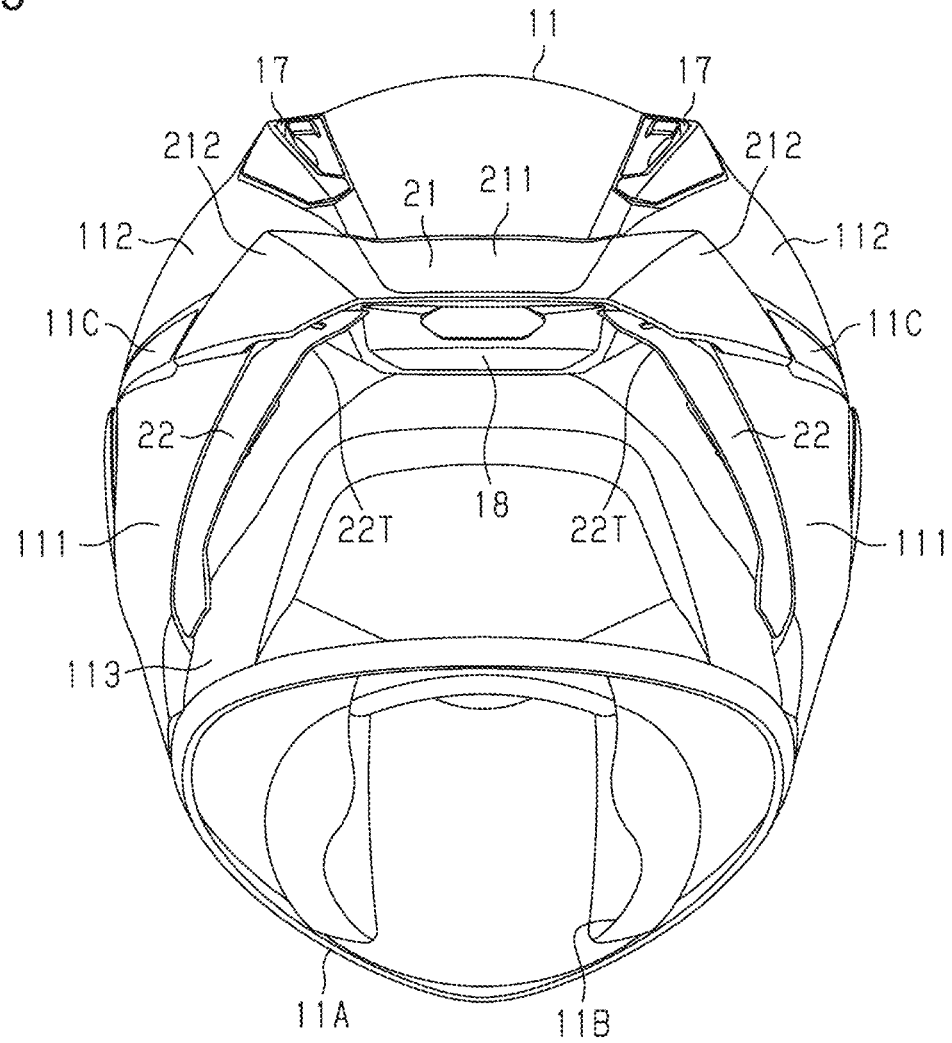
FIG. 3 is a rear view showing the rear structure of the helmet.

As shown in FIG. 3, the rear spoiler 21 is located in the rear part 113 of the shell 11 on the upper shell surface 112. The rear spoiler 21 connects the rear ends of the two inflow guide surfaces 11C at the rear part 113 of the shell 11.

The rear flaps 22, which are located in the rear part 113 of the shell 11, extend from the lower shell surface 111 to the upper shell surface 112. The parts of the rear flaps 22 extending on the upper shell surface 112 are the upper ends of the rear flaps 22. The upper ends of the rear flaps 22 are closer to the shell 11 than the rear spoiler 21 are located in the gap between the rear spoiler 21 and the shell 11.

Figure 4:
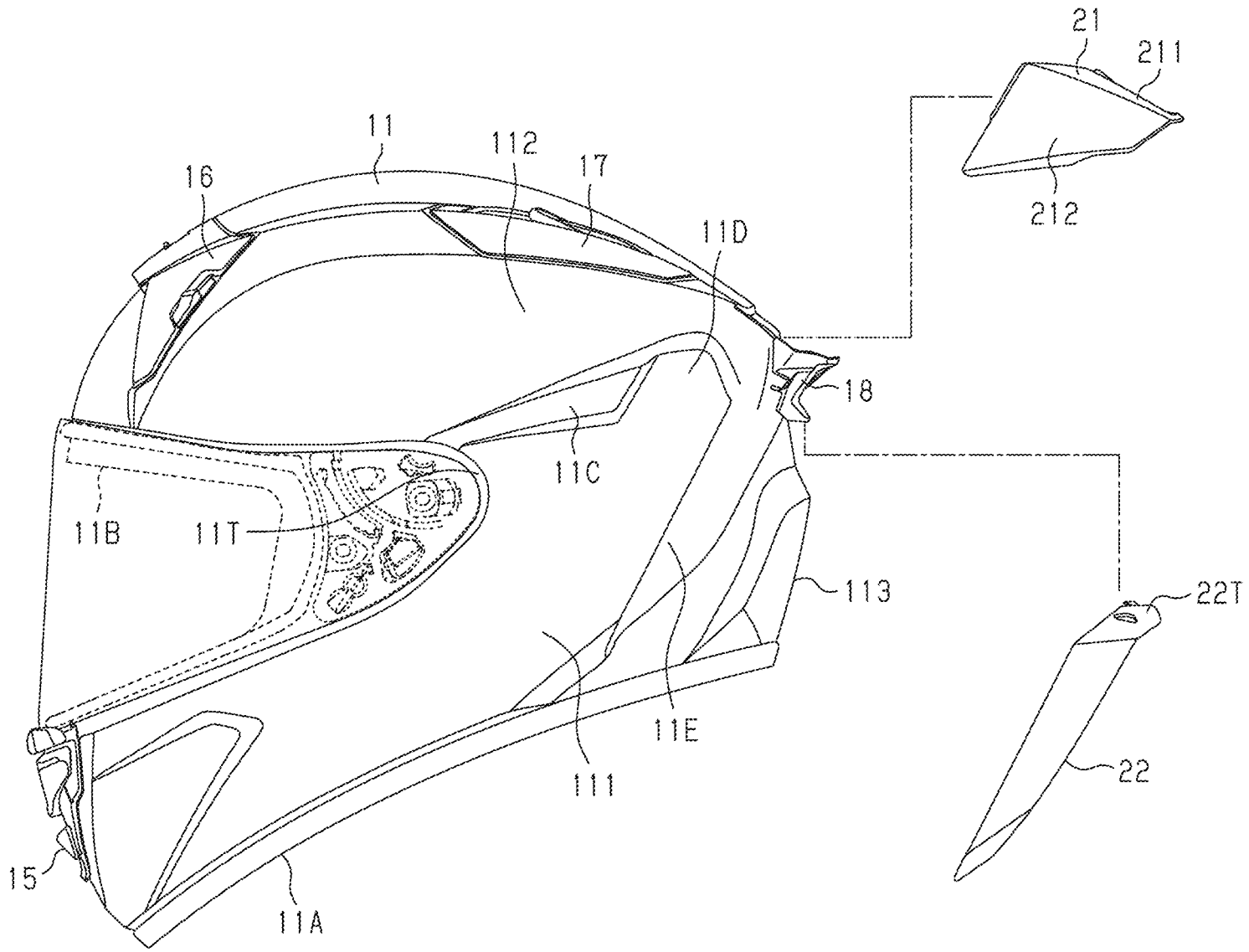
FIG. 4 is a exploded left view separately showing a rear spoiler and a shell.

As shown in FIG. 4, the outer surface of the shell 11 includes wing connectors 11D. The outer surface of the shell 11 may include flap connectors 11E. The outer surface of the shell 11 may include a fastening member 18. The fastening member 18 is located on the rear upper end of the rear part 113 of the shell 11 and fixed to the shell 11.

The wing connectors 11D are located at the rear sides of the inflow guide surfaces 11C on the outer surface of the shell 11. The left and right ends of the rear spoiler 21 are joined with the wing connectors 11D. The wing connectors 11D in the outer surface of the shell 11 are recessed from the inflow guide surfaces 11C by an amount corresponding to the thickness of the rear spoiler 21 thereby allowing the left and right ends of the rear spoiler 21 to be curved continuously with the inflow guide surfaces 11C.

The flap connectors 11E are located in the outer surface of the shell 11 at the rear end of the lower shell surface 111 downward from the wing connectors 11D. The front and rear ends of each rear flap 22 are joined with the corresponding flap connector 11E. The flap connectors 11E in the lower shell surface 111 are recessed from the wing connectors 11D by an amount corresponding to the thickness of the rear flaps 22 thereby allowing the outer surfaces of the rear flaps 22 to be curved continuously with the lower shell surface 111.

Figure 5:
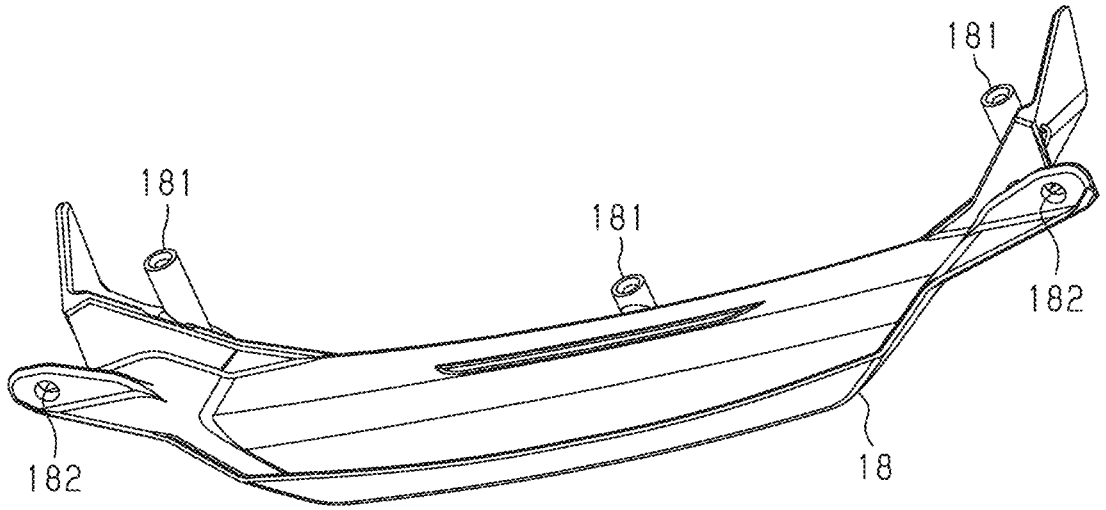
FIG. 5 is a perspective view showing the structure of a fastening member.

As shown in FIG. 5, the fastening member 18 has the form of a curved plate extending in the transverse direction along the outer surface of the shell 11. The fastening member 18 includes spoiler supports 181 and flap supports 182.

The spoiler supports 181 are tubular and extend toward the outer surface of the shell 11. The spoiler supports 181 are fitted to fitting portions 21L of the rear spoiler 21 (refer to FIG. 7) to position the rear spoiler 21. The spoiler supports 181 are fastened by screws to the outer surface of the shell 11 so as that the fastening member 18 presses the rear spoiler 21 against the outer surface of the shell 11.

A fitting hole extends through each flap support 182, which has the form of a plate. Fitting portions 22L of the rear flaps 22 (refer to FIG. 11) are fitted to the flap supports 182 to position the upper ends of the rear flaps 22 relative to the outer surface of the shell 11 and the rear spoiler 21.

(ii) Structure of Rear Spoiler 21

Figure 6:
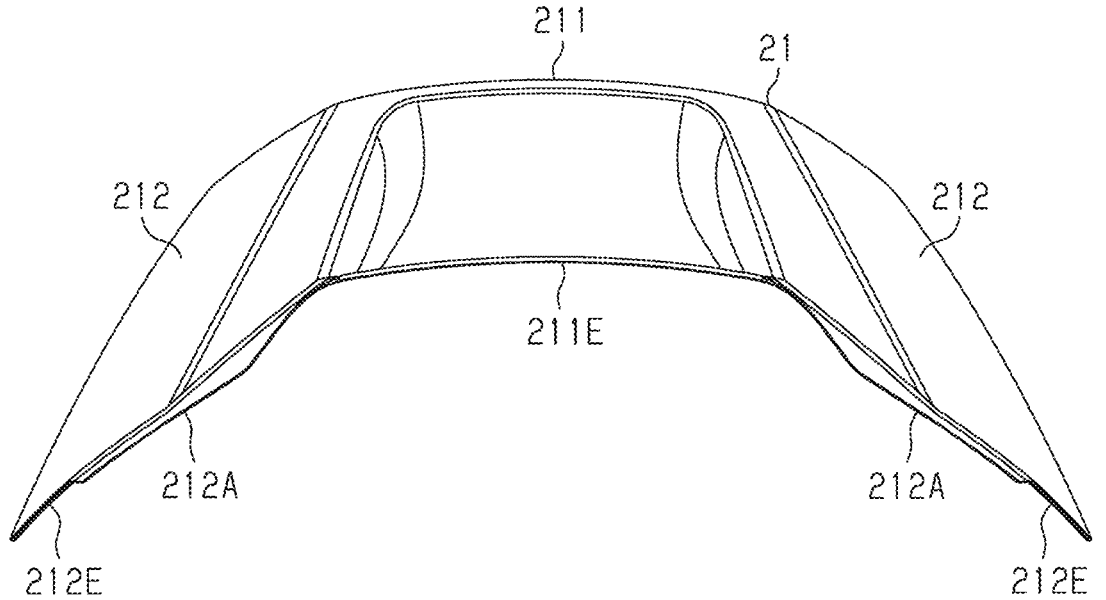
FIG. 6 is a top view showing the upper structure of the rear spoiler.

As shown in FIG. 6, the rear spoiler 21 has the form of a plate extending in the transverse direction. The rear spoiler 21 includes a spoiler portion 211 and two wing portions 212. The two wing portions 212 are arranged on the left and right ends of the spoiler portion 211.

The rear spoiler 21 may be a plastic molded product integrating the spoiler portion 211 and the two wing portions 212. One example of the material forming the rear spoiler 21 is one selected from a group consisting of an acrylonitrile butadiene styrene copolymer, polycarbonate, and a thermosetting resin impregnated with reinforced fibers.

The outer surface of the spoiler portion 211, which is curved and smoothly connected to the left and right sides of the rear part 113 of the shell 11, extends toward the rear from the rear part 113 of the shell 11. The spoiler portion 211 includes a front spoiler edge 211E defined by the front edge of the spoiler portion 211. The front spoiler edge 211E is gradually curved in conformance with the upper end of the rear part 113 of the shell 11.

The spoiler portion 211 presses the rear part 113 of the shell 11 with the front spoiler edge 211E and projects from the rear part 113 toward the rear of the shell 11 in a manner continuous with the rear part 113. The spoiler portion 211, which has an inner surface including one of the fitting portions 21L (refer to FIG. 7), is positioned on the outer surface of the shell 11 by fitting the fitting portion 21L to a spoiler support 181.

Figure 8:
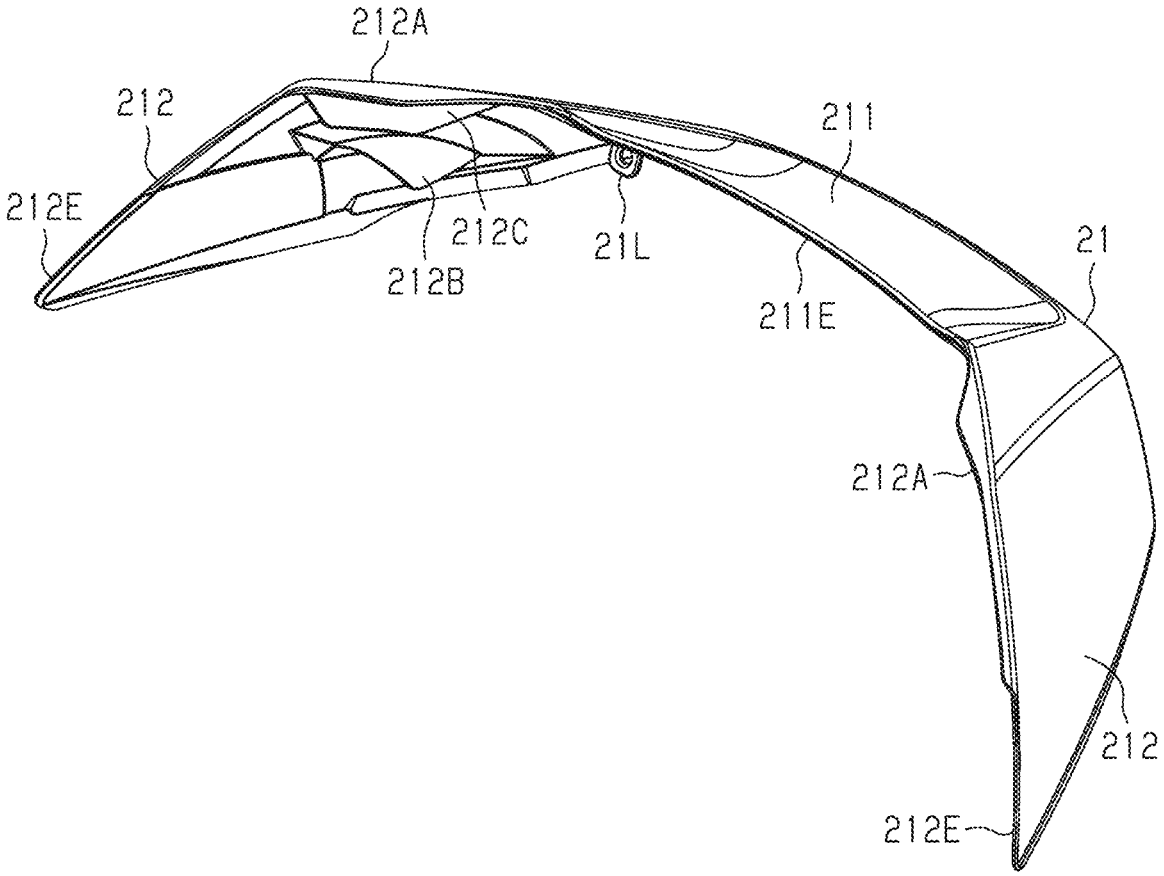
FIG. 8 is a perspective view of a deflector of the rear spoiler taken from the front upper side.

The wing portions 212 are curved extending smoothly toward the rear along the rear end of the upper shell surface 112 and narrowed toward the rear (refer to FIG. 8). The rear end of the upper shell surface 112 includes portions opposing the wing portions 212. The wing portions 212 are curved so that the wing portions 212 are shaped in conformance with the opposing portions (refer to FIG. 9).

The wing portions 212 each include a front wing edge 212E defined by the lower end of the front side of the wing portion 212. The wing portions 212 each include an inflow wing end surface 212A defined by the upper end of the side end surface of the wing portion 212 and located upward from the front wing edge 212E.

The front wing edge 212E is smoothly connected to the rear end of the corresponding inflow guide surface 11C at the rear part 113 of the shell 11 and shaped straight in conformance with the rear end of the inflow guide surface 11C. The wing portions 212, which include the front wing edges 212E pressed against the rear ends of the inflow guide surfaces 11C, extend continuously from the inflow guide surfaces 11C and project toward the rear of the shell 11 from the inflow guide surfaces 11C.

The inflow wing end surface 212A is one example of the front end surface of each wing portion 212. The inflow wing end surface 212A is an inclined surface inclined toward the front lower side of the wing portion 212 (refer to FIG. 8). The inflow wing end surface 212A is inclined so that the outer surface of the shell 11 becomes closer toward the front part of the inflow wing end surface 212A. The inflow wing end surface 212A is inclined so that a wing gap 21H (refer to FIG. 9) between the wing portion 212 and the rear sideward portion of the rear part 113 of the upper shell surface 112 widens from the front toward the rear.

Figure 7:
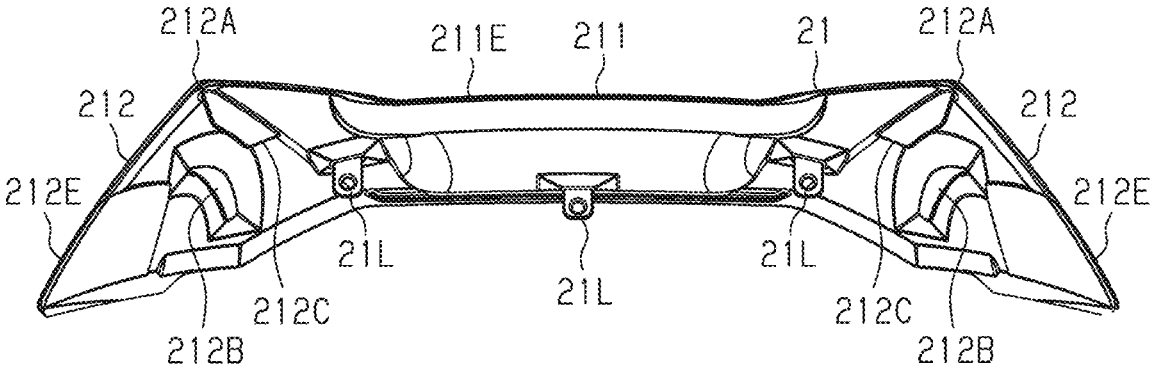
FIG. 7 is an elevational view of the lower structure of the rear spoiler taken from the front side.

As shown in FIG. 7, the two wing portions 212 each include one of the fitting portions 21L. Each of the two wing portions 212 includes one first wing deflector 212B and one second wing deflector 212C. Each of the first wing deflector 212B and the second wing deflector 212C is one example of a deflector that the wing portion 212 includes.

Each wing portion 212 includes one of the fitting portions 21L in the upper end of the wing portion 212. The lower part of the wing portion 212 includes the front wing edge 212E. The lower part of the wing portion 212 is joined with the corresponding wing connector 11D and positioned on the outer surface of the shell 11. The upper end of the wing portion 212 is positioned on the outer surface of the shell 11 by fitting a corresponding one of the spoiler supports 181 to the fitting portion 21L. The wing portion 212 is connected to the wing connector 11D and the spoiler portion 211 so as to be continuous with the corresponding inflow guide surface 11C.

The first wing deflector 212B is arranged on the inner surface of the wing portion 212. The first wing deflector 212B is located between the upper end and the lower end of the wing portion 212. The first wing deflector 212B is located slightly upward from the front wing edge 212E in the vertical direction of the wing portion 212 and located slightly upward from the rear end of the corresponding inflow guide surface 11C.

The first wing deflector 212B is triangular and extends on the inner surface of the wing portion 212 toward the lower rear side (refer to FIG. 8). The front end of the first wing deflector 212B is located rearward from the inflow wing end surface 212A. The first wing deflector 212B extends rearward from the second wing deflector 212C in the front-rear direction of the wing portion 212.

The second wing deflector 212C is arranged on the inner surface of the wing portion 212. The second wing deflector 212C is located between the upper end of the wing portion 212 and the first wing deflector 212B. The second wing deflector 212C is located at the substantially upper end of the wing portion 212 on the inner surface of the wing portions 212. The second wing deflector 212C is located slightly upward from the first wing deflector 212B and arranged upward from the rear end of the inflow guide surface 11C in the vertical direction of the wing portion 212.

The second wing deflector 212C has the form of a trapezoidal plate and extends toward the lower rear side on the inner surface of the wing portion 212 (refer to FIG. 8). The second wing deflector 212C is located upward from the first wing deflector 212B. The second wing deflector 212C extends from the inflow wing end surface 212A in the direction that the first wing deflector 212B extends.

Figure 9:
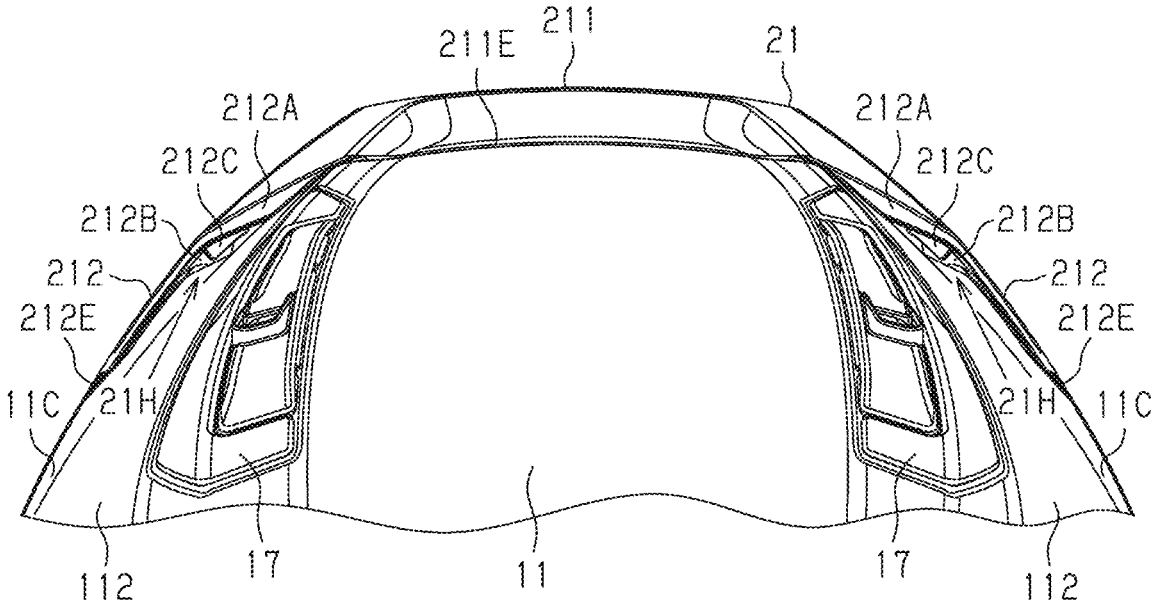
FIG. 9 is a perspective view of the shell and the rear spoiler taken from the front upper side.
Figure 10:
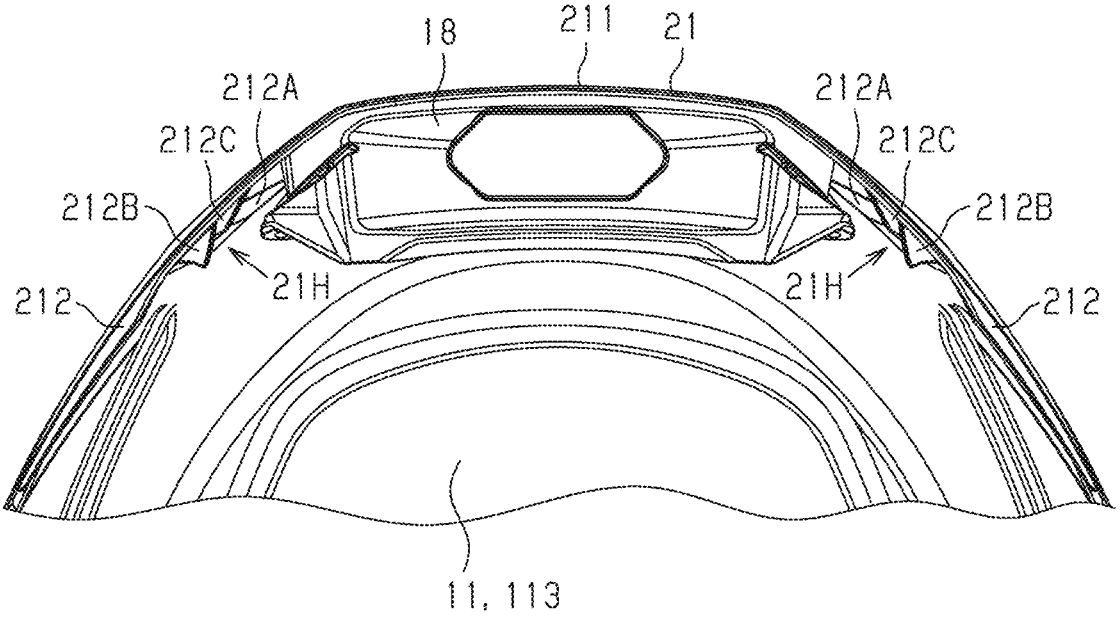
FIG. 10 is a perspective view of the shell and the rear spoiler taken from the rear lower side.

FIG. 9 is a perspective view of the shell 11 and the rear spoiler 21 taken from the front upper side. To illustrate the arrangement of the wing portions 212, the rear flaps 22 are not shown in the drawing. Further, FIG. 10 is a perspective view of the shell 11 and the rear spoiler 21 taken from the rear lower side. To illustrate the arrangement of the wing portions 212, the rear flaps 22 are not shown in the drawing.

As shown in FIG. 9, the wing portions 212 are partially separated from the rear end of the upper shell surface 112. The wing portions 212 each define the wing gap 21H between the inner surface of the corresponding wing portion 212 and the rear sideward portion of the shell 11. The wing gap 21H is tunneled and extends from the front side toward the rear side (refer to FIGS. 10 and 16). The wing gap 21H is thinly layered along the outer surface of the shell 11 and defined between the rear sideward portion of the outer surface of the shell 11 and the wing portion 212, which is curved in conformance with the rear sideward portion.

The wing gap 21H includes an opening facing a part located slightly upward from the rear end of the inflow guide surface 11C in the front-rear direction. The first wing deflector 212B and the second wing deflector 212C are located inside the wing gap 21H. The first wing deflector 212B and the second wing deflector 212C are arranged in the wing gap 21H facing the opening of the wing gap 21H.

As described above, in the flow of air along the outer surface of the shell 11, each inflow guide surface 11C produces an airflow in the direction in which the inflow guide surface 11C extends, and increases the flow velocity of the airflow along the inflow guide surface 11C (refer to FIG. 4). The inflow wing end surface 212A is inclined so that the wing gap 21H widens from the front side toward the rear side. The inflow wing end surface 212A increases the velocity of the airflow entering the wing gap 21H and reduces disturbance in the airflow near the outer surface of the corresponding wing portion 212 (refer to FIG. 9). The wing gap 21H defined between the outer surface of the shell 11 and the wing portion 212 receives the air flowing at a high velocity along the inflow guide surface 11C. The air flowing through the wing gap 21H is changed in direction by the first wing deflector 212B and the second wing deflector 212C toward the rear lower side in the wing gap 21H. The air flowing through the wing gap 21H is deflected by the first wing deflector 212B and the second wing deflector 212C and sent outward toward the rear lower side of the wing portion 212 (refer to FIGS. 10 and 16).

(iii) Structure of Rear Flap 22

Figure 11:
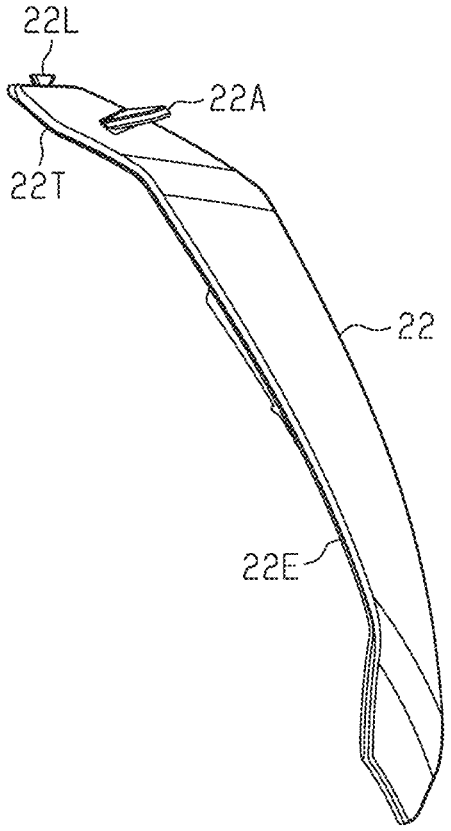
FIG. 11 is a side view showing the outer structure of a rear flap.

As shown in FIG. 11, each rear flap 22 is a plate member extending in the vertical direction. One example of the material forming the rear flap 22 is one selected from a group consisting of an acrylonitrile butadiene styrene copolymer, polycarbonate, and a thermosetting resin impregnated with reinforced fibers.

The outer surface of the rear flap 22 is curved so as to connect smoothly in the vertical direction to the rear part 113 of the shell 11 and extend smoothly toward the rear side. The rear flap 22 includes a front flap edge 22E defined by the front edge of the rear flap 22. The front flap edge 22E is curved gradually in conformance with the lower portion of the rear part 113 of the shell 11. The rear flap 22 projects toward the rear of the shell 11 from the rear part 113 so as to press the front flap edge 22E against the rear part 113 of the shell 11 and be continuous with the rear part 113.

The outer surface at the upper end of the rear flap 22 includes a flap deflector 22A. The flap deflector 22A is one example of a deflector that the rear flap 22 includes. The flap deflector 22A is arranged on the outer surface of the rear flap 22. The flap deflector 22A has the form of a flat plate rising from the outer surface of the rear flap 22 toward the inner surface of the wing portion 212.

Figure 12:
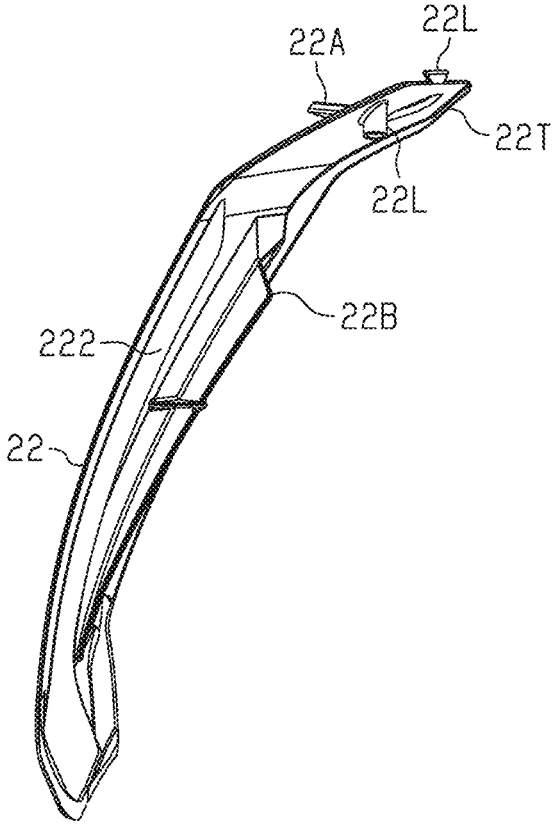
FIG. 12 is a side view showing the inner structure of the rear flap.

As shown in FIG. 12, the upper end of the rear flap 22 defines a flap deflecting portion 22T including the fitting portion 22L projecting upward and a fitting portion 22L projecting downward. The lower part of the rear flap 22 includes the front flap edge 22E (refer to FIG. 11). The lower part of the rear flap 22 is joined with the corresponding flap connector 11E and positioned on the outer surface of the shell 11. The upper end of the rear flap 22 is positioned on the outer surface of the shell 11 by fitting the flap support 182 and the fitting portion 22L.

The inner surface of the rear flap 22 includes a flap connection plate 222 and a gap projection rib 22B. As described above, the flap connector 11E, to which the rear flap 22 is joined, is recessed from the wing connector 11D in the outer surface of the shell 11 so that the outer surface of the rear flap 22 and the lower shell surface 111 form a continuously smooth curved surface. The flap connection plate 222 projects from the inner surface of the rear flap 22 for an amount corresponding to the depth of the flap connector 11E. The flap connection plate 222 is laid over the depth of the flap connector 11E so that the outer surface of the rear flap 22 and the lower shell surface 111 form a smooth curved surface.

The gap projection rib 22B is arranged on the inner surface of the rear flap 22. The gap projection rib 22B is located downward from the flap deflecting portion 22T, which is the upper end of the rear flap 22. The gap projection rib 22B is a reinforcement rib rising from the inner surface of the rear flap 22 toward the flap connector 11E in the direction in which the rear flap 22 extends.

Figure 13:
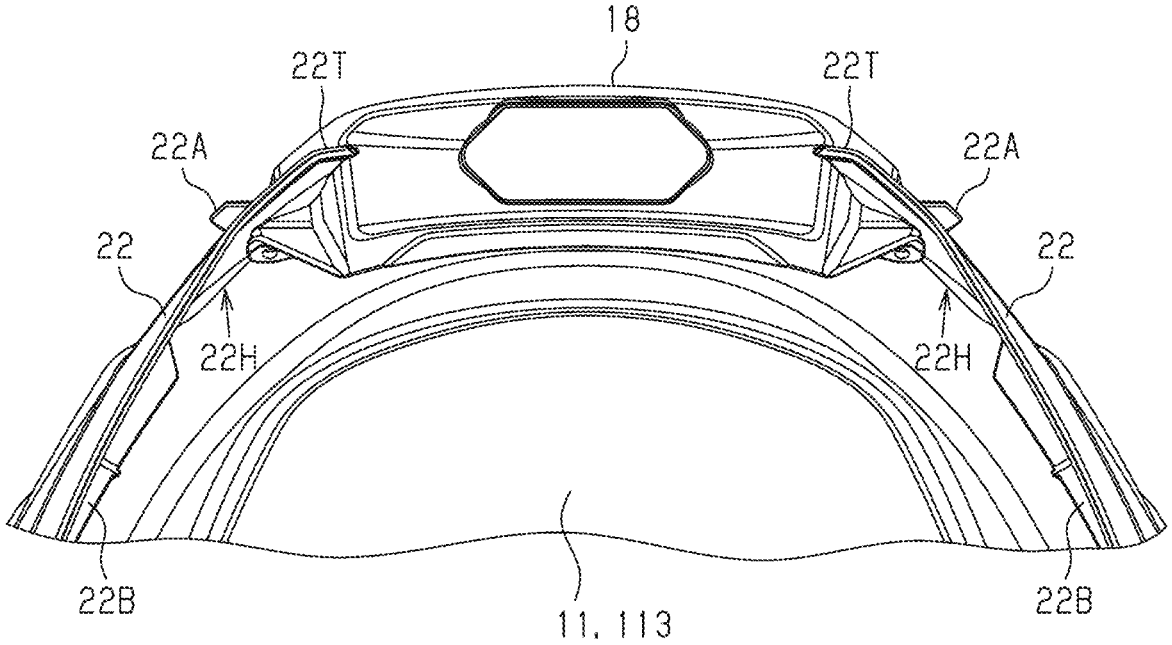
FIG. 13 is a perspective view of the shell and the rear flap taken from the lower rear side.

FIG. 13 is a perspective view of the shell 11 and the rear flaps 22 taken from the lower rear side. To illustrate the arrangement of the rear flaps 22, the rear spoiler 21 is not shown in the drawing.

As shown in FIG. 13, the flap deflecting portion 22T, which is the upper end of the rear flap 22, is separated from the outer surface of the shell 11. The flap deflecting portion 22T of the rear flaps 22 defines a flap gap 22H between the inner surface of the rear flap 22 and the rear sideward portion of the shell 11. The flap gap 22H is tunneled and extends from the front side toward the rear side. The flap gap 22H is thinly layered along the outer surface of the shell 11 and defined between the rear sideward portion in the outer surface of the shell 11 and the rear flap 22, which is curved in conformance with the rear sideward portion. The gap projection rib 22B is arranged to substantially contact the outer surface of the shell 11. The flap deflecting portion 22T and the gap projection rib 22B divide the rear flap 22 in the vertical direction into an upper part and a lower part. The lower end of the flap gap 22H in the vertical direction is located at the upper end of the gap projection rib 22B.

Figure 14:
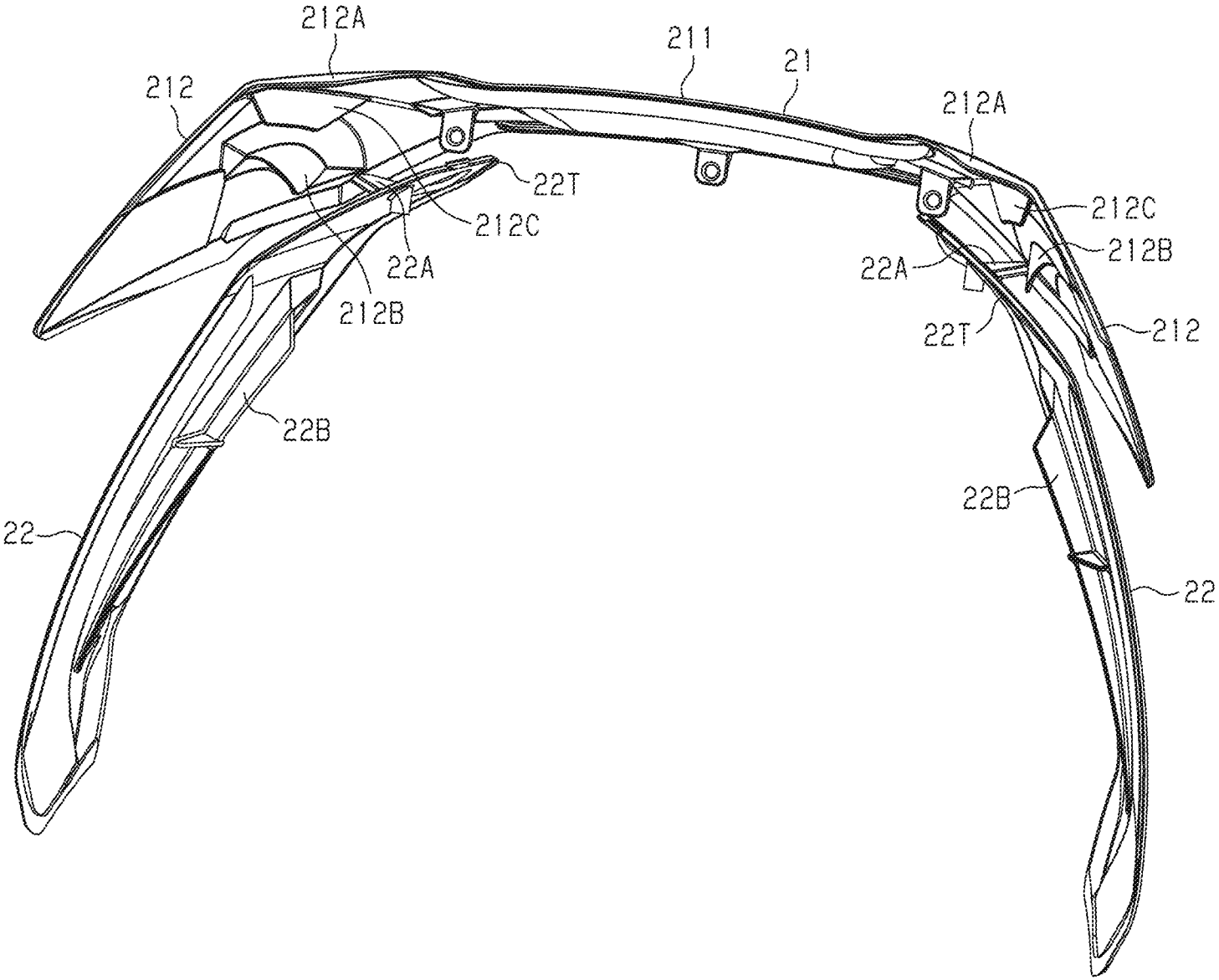
FIG. 14 is a perspective view of airflow control members taken from the front left side.

As shown in FIG. 14, the flap deflecting portion 22T, which is the upper end of the rear flap 22, is arranged downward from the corresponding wing portion 212. The flap deflecting portion 22T of the rear flap 22 is located rearward from the first wing deflector 212B and the second wing deflector 212C. The flap deflector 22A is located rearward from the first wing deflector 212B and the second wing deflector 212C.

Figure 15:
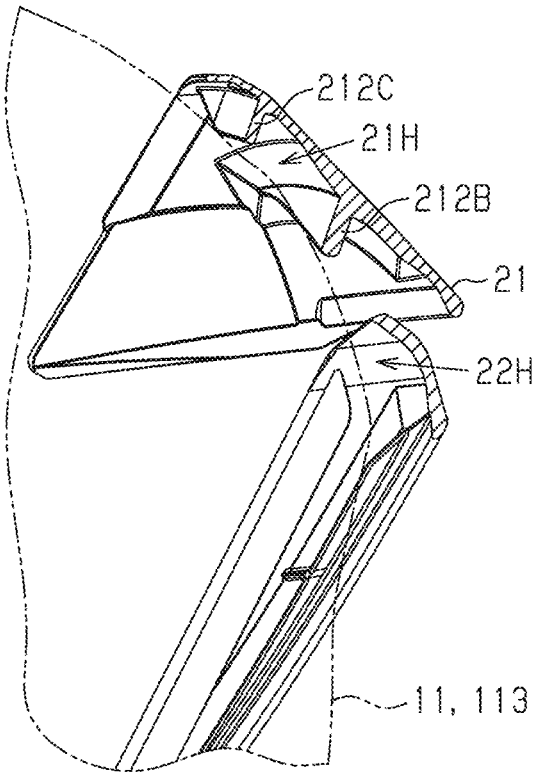
FIG. 15 is a partially cross-sectional view showing the shell and the airflow control members.
Figure 16:
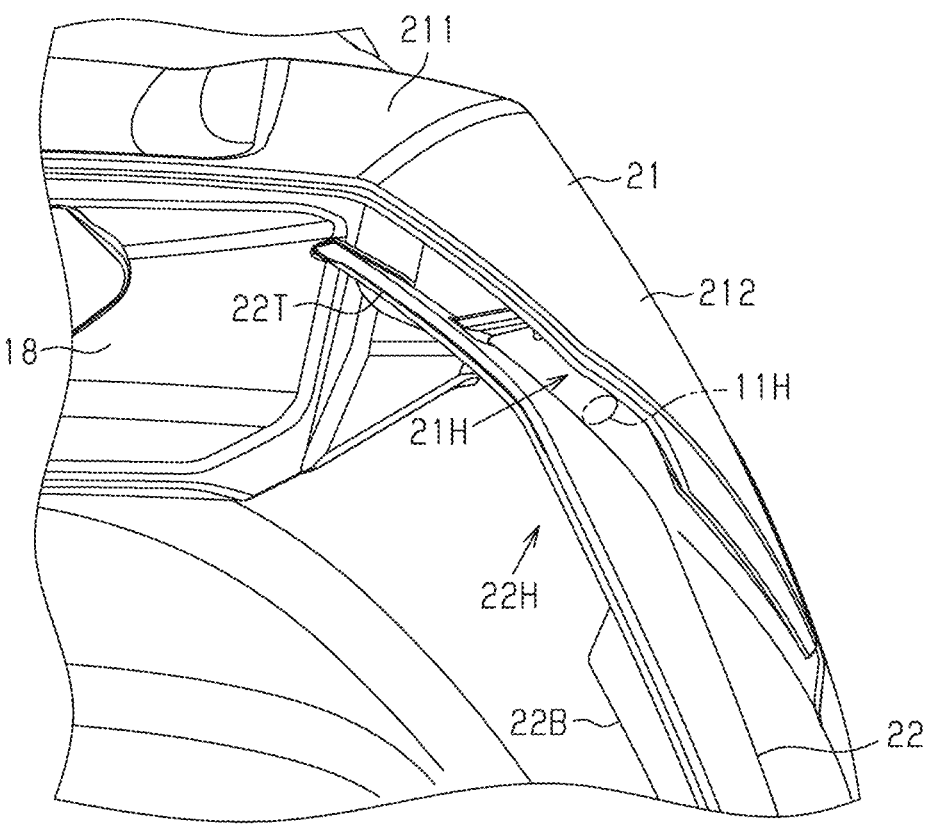
FIG. 16 is a partially enlarged view showing the shell and the airflow control members.

As shown in FIGS. 15 and 16, the flap deflecting portion 22T, which is the upper end of the rear flap 22, is located in the wing gap 21H between the rear sideward portion of the shell 11 and the wing portion 212. The flap deflecting portion 22T of the rear flap 22 divides the rear space of the wing gap 21H with respect to the front-rear direction into two layers extending along the outer surface of the shell 11.

The lower space of the wing gap 21H that is divided into layers defines the flap gap 22H. The flap deflector 22A is arranged in the upper space of the wing gap 21H that is divided into two layers. The flap deflector 22A extends toward the rear lower side in the upper space of the wing gap 21H.

Operation of Helmet

Air flows smoothly along the top of the outer surface of the shell 11. The spoiler portion 211 of the rear spoiler 21 causes the air that flows along the top of the outer surface of the shell 11 to further flow toward the rear of the shell 11. The air flowing toward the rear of the spoiler portion 211 flows away from the helmet at a position located further rearward from the shell 11 by an amount corresponding to the spoiler portion 211.

Air flows smoothly along the sideward portions of the outer surface of the shell 11. The rear flaps 22 cause the air flowing along the sideward portions of the outer surface of the shell 11 to further flow toward the rear of the helmet body. The air flowing toward the rear the rear flaps 22 flows away from the helmet at a position located further rearward from the shell 11 by an amount corresponding to the rear flaps 22.

Air flows smoothly along the sideward portions of the outer surface of the shell 11. The wing portion 212 of each rear spoiler 21 receives air resistance, which acts to pull the shell 11 toward the rear, from the air flowing along the side portion of the outer surface of the shell 11. In this state, the first wing deflector 212B and the second wing deflector 212C are located in the wing gap 21H between the outer surface of the shell 11 and the wing portion 212. The first wing deflector 212B and the second wing deflector 212C direct the flow of air flowing from the front end of the wing gap 21H into the wing gap 21H so that the air is sent out of the rear end of the wing gap 21H toward the lower rear side.

As a result, the wing portion 212 of the rear spoiler 21 changes the direction of the force received from the air flowing along the sideward portion of the shell 11 from the rearward direction, in which the shell 11 is pulled rearward, to the rear lower direction.

Figure 17:
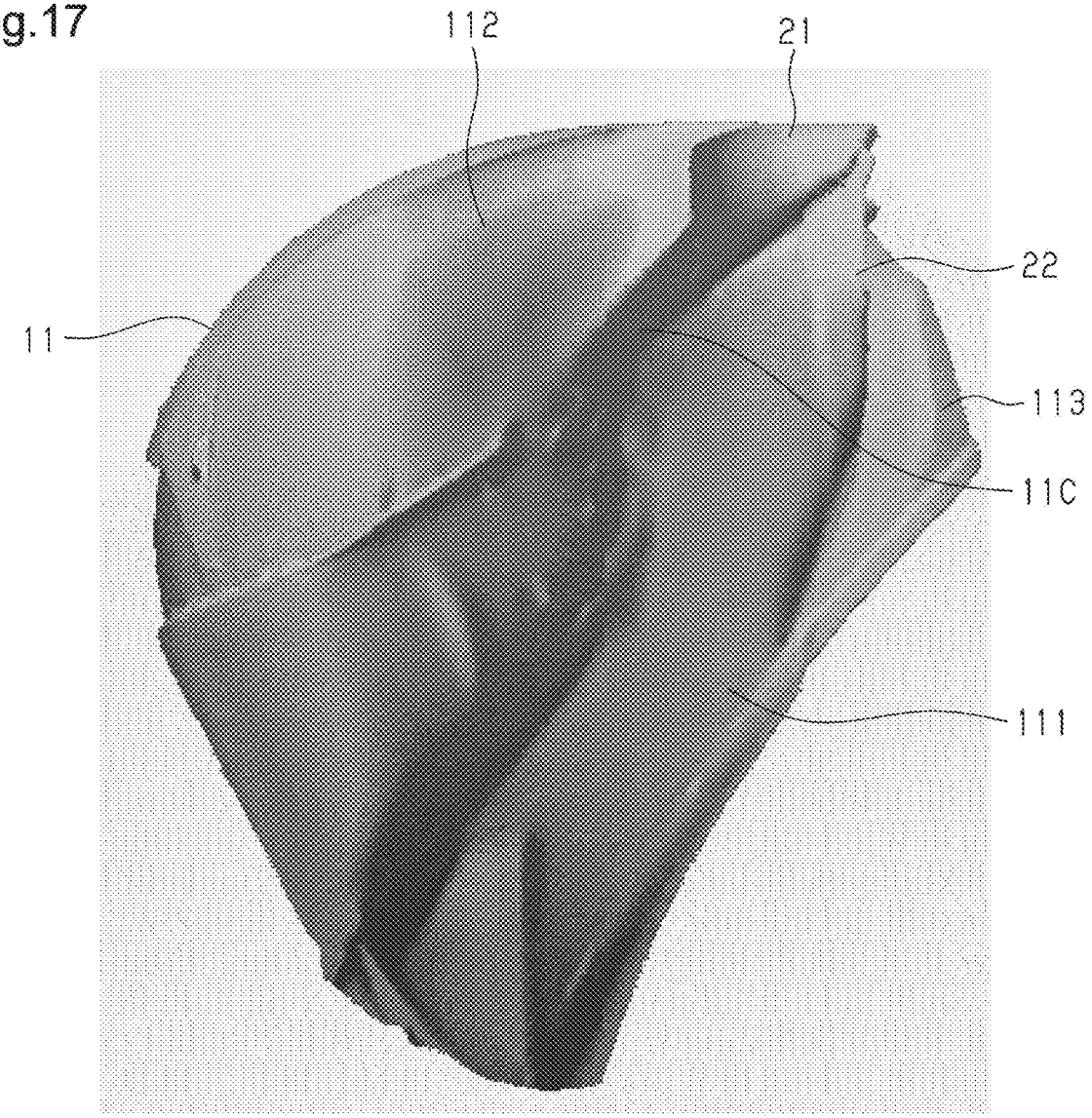
FIG. 17 is a diagram illustrating a fluid analysis result of the airflow around the helmet.

FIG. 17 shows a fluid analysis result of the airflow around the helmet. The fluid analysis result of the airflow is an analysis result using a CFD simulation. In FIG. 17, darker portions are where the flow velocity is higher.

A surface, such as the inflow guide surface 11C described above, rising from a smooth surface decreases the flow velocity of air in front of the rising surface and increases the flow velocity at the rear of the rising surface. As a result, as shown in FIG. 17, the inflow guide surface 11C directs the air flowing at a relatively high speed along the outer surface of the shell 11 in the direction in which the inflow guide surface 11C extends. Thus, the relatively fast airflow enters the wing gap 21H between the rear sideward portion of the outer surface of the shell 11 and the wing portion 212.

Figure 18:
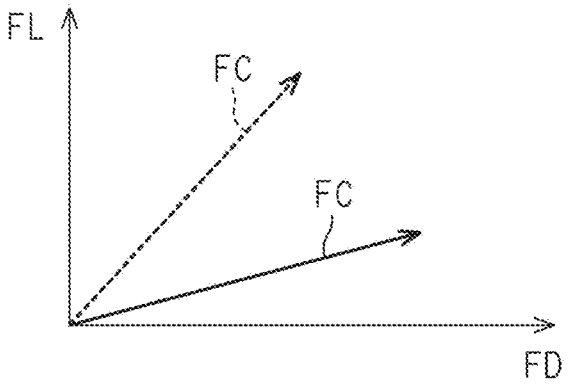
FIG. 18 is a graph showing the components of the forces received by the shell.

As shown in FIG. 18, the resultant force FC received by the shell 11 as an action of wind is a combination of a component FL that lifts the shell 11 and a component FD that rearwardly pulls the shell 11. As described above, the air flowing along the sideward portions of the outer surface of the shell 11 is deflected by the wing portions 212 of the rear spoiler 21 so that the direction of the force acting on the shell 11 is changed to the rear lower direction.

Such change in the direction of one component resulting from the wing portions 212 substantially limits increases in the component FD that rearwardly pulls the shell 11 while reducing the component FL that lifts the shell 11 so that the resultant force FC changes as shown in FIG. 18 from the broken line to the solid line. Thus, the helmet reduces the force acting to lift the head of the wearer and improves the wearing comfort when the wearer is traveling. The airflow deflected by the inflow guide surface 11C substantially limits increases in the component FD that rearwardly pulls the shell 11, while effectively changing the direction of the force acting on the shell 11 to the rear lower direction.

The above embodiment has the advantages described below.

(1) The air flowing along the top of the outer surface of the shell 11 flows away from the helmet at a position located further rearward from the helmet by an amount corresponding to the spoiler portion 211 so that the produced vortex is small and swirling is limited. Further, the air flowing along the sideward portions of the outer surface of the shell 11 flows away from the helmet at a position located further rearward from the helmet by an amount corresponding to the rear flaps 22 so that the produced vortex is small and swirling is limited. Consequently, this limits the formation of vortexes at the rear of the helmet and increases stability of the wearer.

(2) The wing portions 212 change the direction of one component. This substantially limits increases in the component FD that rearwardly pulls the shell 11, while reducing the component FL that lifts the shell 11 in the resultant force FC. Thus, the helmet reduces the force acting to lift the head of the wearer and improves the wearing comfort when the wearer is traveling.

(3) The spoiler portion 211 and the two wing portions 212 form an integrated structure. This easily increases the mechanical strength of the two wing portions 212. Each wing portion 212 may include two deflectors. When each wing portion 212 includes two deflectors, the wing portion 212 effectively changes the direction of one component.

(4) The upper end of each rear flap 22 divides, in a layered manner, the wing gap 21H into the flap gap 22H and another space. The wing gap 21H, which is divided by the upper end of the rear flap 22, guides the air flowing in the wing gap 21H in a layered manner along the rear sideward portion. As a result, the upper end of the rear flap 22 deflects the flow of air and increases the effect of advantage (2), which is described above. Further, the upper end of the rear flap 22 deflects the airflow so that the direction of the force received from the air flowing along the sideward portion can be controlled more finely than when deflecting the airflow with only the wing portion 212.

(5) The air flowing into each wing gap 21H is first deflected downward from the front end of the wing gap 21H by the first wing deflector 212B and the second wing deflector 212C of the wing portion 212. The deflected air is then guided by the upper end of the rear flap 22 to flow in a layered manner along the rear sideward portion, and guided by the flap deflector 22A of the rear flap 22 toward the rear lower side. The flow of air deflected by the flap deflector 22A increases the effect of advantage (2).

(6) The inflow wing end surface 212A is inclined to widen the wing gap 21H from the front side toward the rear side. This increases the velocity of the air flowing through the wing gap 21H, and reduces disturbance in the airflow near the outer surface of the wing portion 212.

The above embodiment may be modified as described below.

Airflow Controller

The spoiler portion 211 and the two wing portions 212 may be separate plastic molded products. Nevertheless, when the rear spoiler 21 is a plastic molded product integrating the spoiler portion 211 and the two wing portions 212, the mechanical strength of the two wing portions 212 is easily increased. Further, the integrity of the spoiler portion 211 and the two wing portions 212 increases the aesthetic appeal.

The mechanical strength of the wing portions 212 that is easily increased allows each wing portion 212 to include more than one deflector. When each wing portion 212 includes a plurality of deflectors, the direction of the force received by the wing portion 212 is effectively changed. Further, when each wing portion 212 includes deflectors of different shapes, the direction of the resultant force is controlled with higher accuracy.

In the above embodiment, the rear spoiler 21 and the two rear flaps 22 form the airflow controller. However, this is only an example. The two rear flaps 22 may be omitted from the helmet. The helmet including the wing portions 212 changes the direction of the force that the wing portions 212 receive from air. Thus, as long as the helmet includes the wing portions 212, even without the rear flaps 22, advantage (2) can be obtained. The flap deflecting portion 22T, which is the upper end of each rear flap 22, divides the wing gap 21H into two layers. This deflects the airflow and increases the velocity of the airflow in the wing gap 21H. Thus, the airflow controller effectively improves the wearing comfort.

The front end surface of each wing portion 212 may be shaped in conformance with the outer surface of the shell 11. That is, the front end surface of each wing portion 212 may be shaped so that the spacing of the wing gap 21H is substantially uniform from the front side to the rear side. Nevertheless, as long as the front end surface of the wing portion 212 is an inclined surface that widens the wing gap 21H from the front side toward the rear side, advantage (6) can be obtained.

The quantity of deflectors included in each wing portion 212 may be one, three, or more. Each wing portion 212 may include only the first wing deflector 212B or only the second wing deflector 212C.

The first wing deflector 212B, the second wing deflector 212C, and the flap deflector 22A may be shaped to extend in the rear lower direction, be parallel to one another, or be shaped to extend in different directions. The rear lower side of each of the first wing deflector 212B, the second wing deflector 212C, and the flap deflector 22A may each be shaped to extend toward the inner side in the transverse direction or each be shaped to extend toward the outer side in the transverse direction.

The deflectors may be omitted from the wing portions 212. In such a case, the wing portions 212 are configured to change the direction of the force that the wing portions 212 receive from air toward the rear lower side. For example, each wing portion 212 may be shaped to define the wing gap 21H that extends from the front side to the rear lower side in each wing portion 212. For example, the outer surface of the shell 11 may include a recess extending from the front side toward the rear lower side, and the recess in the outer surface of the shell 11 may be shaped to define the wing gap 21H that extends from the front side to the rear lower side in each wing portion 212. The wing portion 212 may include a passage extending from the front side toward the rear lower side.

The rear spoiler 21 may be omitted from the helmet, and the wing portions 212 may be omitted from the helmet. Each wing portion 212 is curved in conformance with the part of the rear sideward portion of the shell 11 facing the wing portion 212, and arranged to define a gap extending from the front side to the rear side between the rear sideward portion and the wing portion 212. Such functionalities of the wing portion 212 may be provided in the rear flaps 22. For example, when the wing portion 212 is omitted, the flap deflecting portion 22T of the rear flap 22 may form the flap gap 22H so that the direction of the force that the rear flap 22 receives from air is changed to the rear lower side. In such a structure, the flap deflecting portion 22T of the rear flap 22 acts as the wing portion.

At least one of the shell 11, the wing gap 21H, and the flap gap 22H may include a hole 11H (refer to FIG. 16) so that the air drawn into the shell 11 is sent out of the shell 11. More specifically, the rear sideward portion of the shell 11 may include the hole 11H at a part facing a wing portion 212 and/or a rear flap 22 to allow air to flow out of the shell 11. The hole 11H may be the outlet of a passage branched from a passage connected to the top outlets 17 and the outlet of a passage that is independent from a passage connected to the top outlets 17. The wing gap 21H and the flap gap 22H are passages through which air flows at a high velocity. A structure that sends out air through such a gap, that is, the structure in which at least one of the wing gap 21H and the flap gap 22H includes the hole 11H having the functionality of an outlet, increases the air discharging efficiency of the outlet. This increases the efficiency for sending air out of the shell 11.

Helmet

The helmet is not limited to a full face helmet and may be changed to any of various types of helmet such as a flip up helmet with a chin portion that can be raised or an open face helmet with no chin portion.

The invention claimed is:

1. A helmet comprising:

a helmet body; and an airflow controller attached to an outer surface of the helmet body, wherein the airflow controller includes two wing portions sandwiching a rear part of the outer surface of the helmet body in a transverse direction, each of the two wing portions is connected to a rearward portion of the outer surface of the helmet body in a manner continuous with a part of the rearward portion, each of the two wing portions is curved in conformance with a portion of the rearward portion that faces the wing portion, each of the two wing portions defines a gap with the rearward portion extending from a front side toward a rear side with the rearward portion, and each of the two wing portions is configured to send air entering a front side of the gap out of the gap toward a lower rear side, the airflow controller further includes a deflector extending toward a rear lower side in the gap, and the deflector is arranged on an inner surface of one of the two wing portions.

2. The helmet according to claim 1, wherein the helmet body includes a hole that allows air to flow out of the helmet body at a portion of the rearward portion opposing one of the two wing portions.

3. The helmet according to claim 1, wherein the airflow controller further includes a spoiler portion projecting toward a rear side of the helmet body from the rear part in the outer surface of the helmet body in a manner continuous with the rear part, the spoiler portion is sandwiched between the two wing portions in the transverse direction, each of the two wing portions is connected to the rearward portion and the spoiler portion in a manner continuous with the part of the rearward portion of the outer surface of the helmet body, and each of the two wing portions defines the gap between the rearward portion and the spoiler portion, the airflow controller is a plastic molded product in which the spoiler portion and the two wing portions are molded integrally.

4. The helmet according to claim 1, wherein one of the two wing portions includes a front end surface, and the front end surface is inclined so that the gap between the rearward portion and the wing portion widens from a front side toward a rear side.

5. The helmet according to claim 1, wherein a sideward portion of the outer surface of the helmet body includes an inflow guide surface, and the inflow guide surface is an outwardly bulging curved surface in the sideward portion of the outer surface of the helmet body and extends continuously from a front part of the helmet body toward a front side of the gap between the rearward portion and one of the two wing portions so that wind enters the gap from the front side of the gap.

6. A helmet comprising:

a helmet body; and an airflow controller attached to an outer surface of the helmet body, wherein the airflow controller includes two wing portions sandwiching a rear part of the outer surface of the helmet body in a transverse direction, each of the two wing portions is connected to a rearward portion of the outer surface of the helmet body in a manner continuous with a part of the rearward portion, each of the two wing portions is curved in conformance with a portion of the rearward portion that faces the wing portion, each of the two wing portions defines a gap with the rearward portion extending from a front side toward a rear side with the rearward portion, and each of the two wing portions is configured to send air entering a front side of the gap out of the gap toward a lower rear side, the part of the rearward portion of the outer surface of the helmet body is a wing connector, the rearward portion of the outer surface of the helmet body includes a flap connector at a rear lower side of the wing connector, the airflow controller includes a first airflow control member including the two wing portions, and a second airflow control member that is a flap located at a lower rear side of the first airflow control member, the second airflow control member has the form of a plate projecting toward a rear side of the helmet body from the rearward portion in a manner continuous with the flap connector, and the second airflow control member includes an upper end located in the gap so that the gap between the rearward portion and one of the two wing portions is divided into two layers extending along the outer surface of the helmet body.

7. The helmet according to claim 6, wherein the upper end of the second airflow control member includes a deflector extending toward a rear lower side in a gap between the upper end of the second airflow control member and the first airflow control member.

* * * * *